US012616352B2

(12) United States Patent
Howe et al.

(10) Patent No.: US 12,616,352 B2
(45) Date of Patent: May 5, 2026

(54) SPRAY ARM ASSEMBLY AND GLASSWASHER INCORPORATING THE SAME

(71) Applicant: Moyer Diebel Ltd., Jordan Station (CA)

(72) Inventors: Raymond Charles Howe, Grimsby (CA); Ivan Josip Katkic, Milton (CA)

(73) Assignee: Moyer Diebel Ltd., Jordan Station (CA)

( * ) Notice: Subject to any disclaimer, the term of this patent is extended or adjusted under 35 U.S.C. 154(b) by 251 days.

(21) Appl. No.: 18/537,097

(22) Filed: Dec. 12, 2023

(65) Prior Publication Data

US 2024/0188788 A1 Jun. 13, 2024

Related U.S. Application Data

(60) Provisional application No. 63/432,189, filed on Dec. 13, 2022.

(51) Int. Cl.

| | |
|---|---|
| ***A47L 15/00*** | (2006.01) |
| ***A47L 15/23*** | (2006.01) |
| ***A47L 15/24*** | (2006.01) |

(52) U.S. Cl.
CPC ..... *A47L 15/0073* (2013.01); *A47L 15/23* (2013.01); *A47L 15/247* (2013.01)

(58) Field of Classification Search
None
See application file for complete search history.

(56) References Cited

U.S. PATENT DOCUMENTS

| | | | | |
|---|---|---|---|---|
| 3,886,958 A * | 6/1975 | Diebel | A47L 15/243 285/137.11 |
| 10,368,718 B2 * | 8/2019 | Wilson | A47L 15/505 |

* cited by examiner

*Primary Examiner* — Rita P Adhlakha
(74) *Attorney, Agent, or Firm* — Rowand LLP

(57) ABSTRACT

A spray arm assembly comprises a housing defining at least one locating port that includes at least one opening; a spring-loaded connector having a body complementary in shape to the at least one locating port and removably connected to the housing within the at least one locating port, the spring-loaded connector having an inlet in fluid communication with the at least one opening when connected to the housing within the at least one locating portand an outlet; and at least one spray arm connected to the spring-loaded connector such that the spray arm is in fluid communication with the outlet of the spring-loaded connector.

19 Claims, 17 Drawing Sheets

SPRAY ARM ASSEMBLY AND GLASSWASHER INCORPORATING THE SAME

CROSS-REFERENCE TO RELATED APPLICATIONS

This application claims the benefit of U.S. Provisional Application No. 63/432,189 filed on Dec. 13, 2022, the entire contents of which are incorporated herein by reference.

TECHNICAL FIELD

The present disclosure relates to a spray arm assembly and a glasswasher incorporating the same.

BACKGROUND

Spray arm assemblies are used to direct the egress of fluid received from a fluid supply towards one or more objects. Spray arm assemblies often include a housing and one or more spray arms held within the housing. Spray arms are often difficult to remove from the housing due to the build up of debris, etc. As such, tasks such as cleaning the spray arms, replacing the spray arms, or repairing the spray arms may be difficult.

BRIEF DESCRIPTION OF THE DRAWINGS

Embodiments are described in detail below, with reference to the following drawings.

Like reference numerals are used in the drawings to denote like elements and features.

DETAILED DESCRIPTION OF VARIOUS EMBODIMENTS

Figure 1:
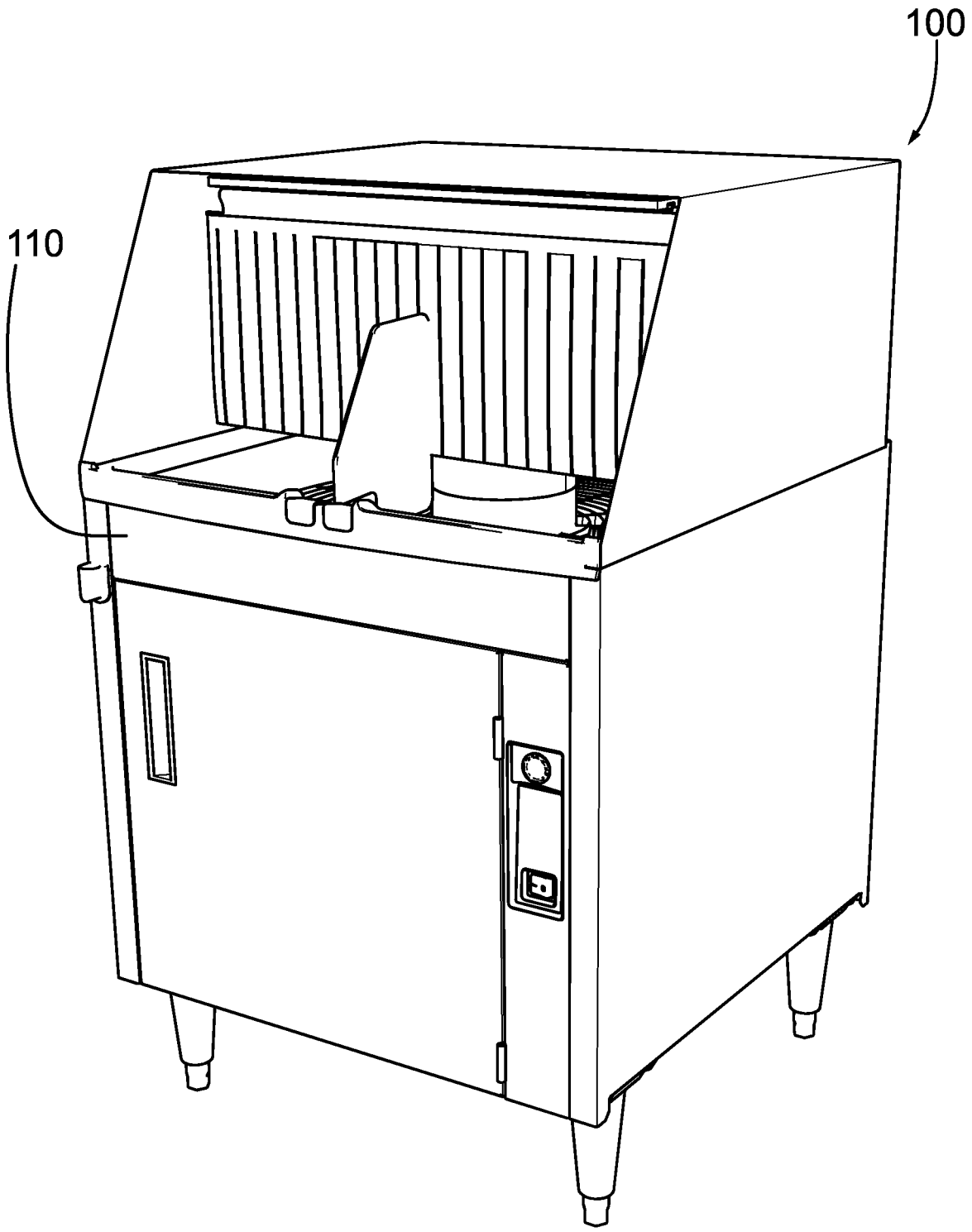
FIG. 1 is an isometric view of an on-demand glasswasher.

Accordingly, in one aspect there is provided a spray arm assembly comprising a housing defining at least one locating port that includes at least one opening; a spring-loaded connector having a body complementary in shape to the at least one locating port and removably connected to the housing within the at least one locating port, the spring-loaded connector having an inlet in fluid communication with the at least one opening when connected to the housing within the at least one locating port and at least one outlet; and at least one spray arm connected to the spring-loaded connector such that the spray arm is in fluid communication with the at least one outlet of the spring-loaded connector.

In one or more embodiments, the spring-loaded connector includes a body and a yoke pivotally connected to the body via a torsion spring.

In one or more embodiments, the housing includes a feature that exerts a force on the yoke during insertion of the spring-loaded connector into the port and causes the yoke to pivot with respect to the body during the insertion.

In one or more embodiments, the torsion spring is in a locked when the spring-loaded connector is connected to the housing.

In one or more embodiments, the torsion spring follows an installation path during insertion of the spring-loaded connector into the housing.

In one or more embodiments, the at least one locating port includes a feature to identify the at least one locating port as one of a wash arm port or a spray arm port.

In one or more embodiments, the spring-loaded connector includes a feature complementary to the feature of the at least one locating port to identify the spring-loaded connector as one of a wash arm spring-loaded connector or a spray arm spring-loaded connector.

In one or more embodiments, the housing includes a ridge that is positioned to receive and engage with an end of the spring-loaded connector during insertion of the spring-loaded connector.

In one or more embodiments, the spring-loaded connector includes side portions that are complementary in shape to shoulders defined in side walls of the at least one locating port.

In one or more embodiments, the at least one spray arm includes at least two spray arms connected to the spring-loaded connector.

In one or more embodiments, the at least two spray arms extend out from the spring-loaded connector in a V-shape formation.

In one or more embodiments, fluid is received from a fluid source and travels through the at least one opening in the housing, through the inlet of the spring-loaded connector, out through the at least one outlet of the spring-loaded connector to the at least one spray arm, and is directed out through at least one nozzle of the at least one spray arm.

In one or more embodiments, the at least one spray arm includes at least one of a wash arm or a rinse arm.

According to another aspect there is provided an on-demand glasswasher comprising a spray arm assembly fluidly connected to at least one of a rinse system or a wash system of the on-demand glasswasher, the spray arm assembly comprising a housing defining at least one locating port that includes at least one opening that receives fluid from the rinse system or the wash system; a spring-loaded connector having a body complementary in shape to the at least one locating port and removably connected to the housing within the at least one locating port, the spring-loaded connector having an inlet in fluid communication with the at least one opening when connected to the housing within the at least one locating port and at least one outlet; and at least one spray arm connected to the spring-loaded connector such that the spray arm is in fluid communication with the at least one outlet of the spring-loaded connector.

In one or more embodiments, the spray arm assembly includes at least one of an upper spray arm assembly or a lower spray arm assembly.

In one or more embodiments, the spray arm assembly includes at least a first locating port that receives fluid from the rinse system and at least a second locating port that receives fluid from the wash system.

In one or more embodiments, the spray arm assembly includes at least a first spring-loaded connector removably connected to the housing within the first locating port and at least a second spring-loaded connector removably connected to the housing within the second locating port.

In one or more embodiments, the at least one spray arm includes at least one rinse arm connected to the first spring-loaded connector and at least one wash arm connected to the second spring-loaded connector.

In one or more embodiments, the spray arm assembly is positioned above or below a rotary conveyor of the on-demand glasswasher.

In one or more embodiments, at least a first spray arm assembly is positioned above a rotary conveyor of the on-demand glasswasher and at least a second spray arm assembly is positioned below the rotary conveyor of the on-demand glasswasher.

Other aspects and features of the present application will be understood by those of ordinary skill in the art from a review of the following description of examples in conjunction with the accompanying figures.

In the present application, the term "and/or" is intended to cover all possible combinations and sub-combinations of the listed elements, including any one of the listed elements alone, any sub-combination, or all of the elements, and without necessarily excluding additional elements.

In the present application, the phrase "at least one of . . . and . . . " is intended to cover any one or more of the listed elements, including any one of the listed elements alone, any sub-combination, or all of the elements, without necessarily excluding any additional elements, and without necessarily requiring all of the elements.

Figure 2:
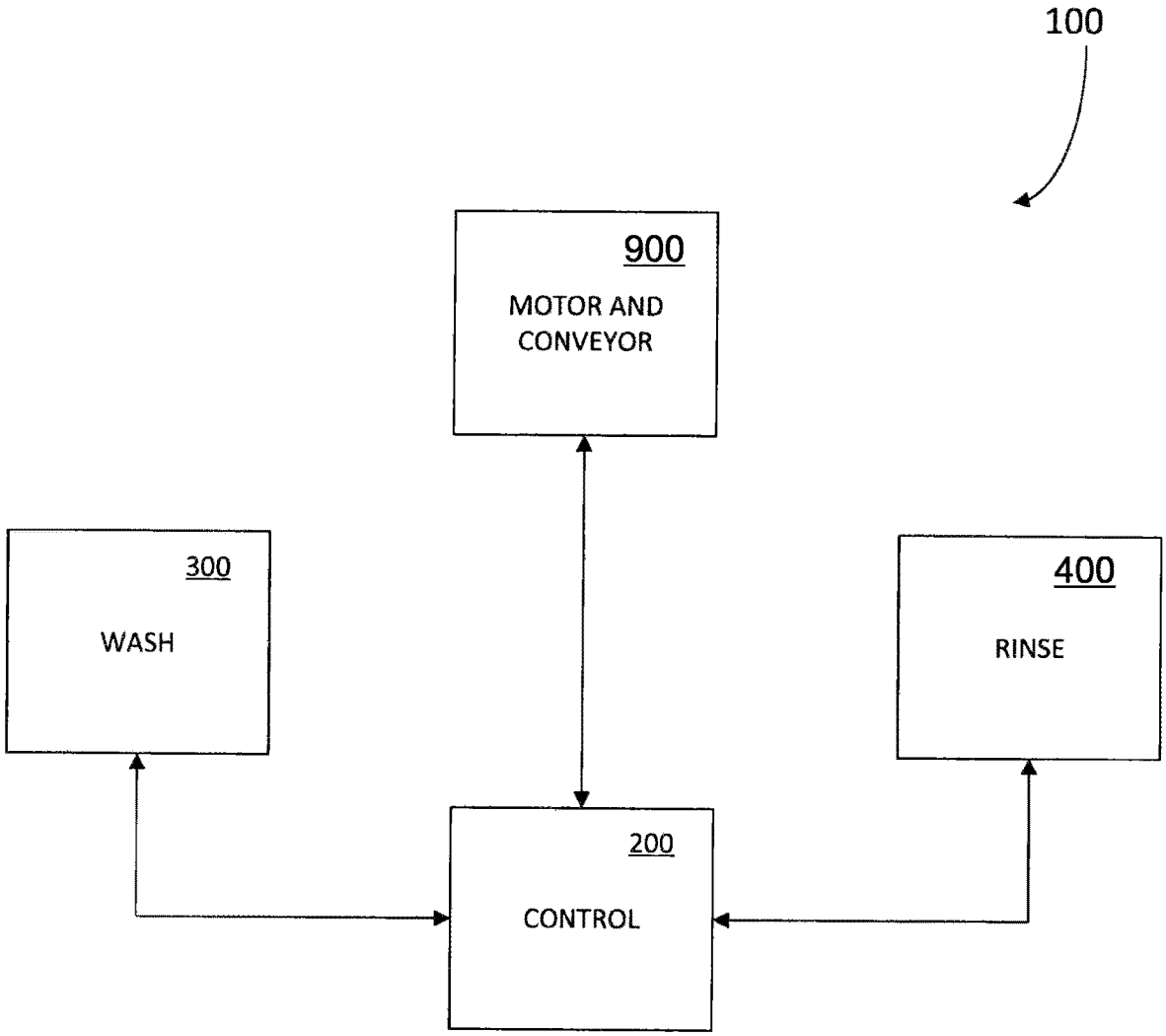
FIG. 2 is a schematic view showing various components of the on-demand glasswasher of FIG. 1.

Turning to FIGS. 1 and 2, an on-demand glasswasher is shown and is generally identified by reference numeral 100. The on-demand glasswasher 100 includes a control system 200 (FIG. 2), a wash system 300 (FIG. 3), a rinse system 400 (FIG. 4), an upper spray arm assembly 500 and a lower spray arm assembly 505 (FIG. 5 to FIG. 10), a motor and conveyor system 900 (FIG. 11), a sanitary divider 1000 (FIG. 12), a cylinder 1100 (FIG. 13) and a housing 110 that houses the various components therein. The on-demand glasswasher 100 includes a rotary conveyor and is used to wash glasses such as for example glassware, drinkware, barware, wine glasses, etc. as they travel along the rotary conveyor.

The control system 200 includes at least a microprocessor and a memory device. The memory device is provided to store, amongst other things, instructions that, when executed by the microprocessor, causes the microprocessor to control operation of the on-demand glasswasher 100 and the various components thereof. Example instructions will be described in more detail below.

Figure 3:
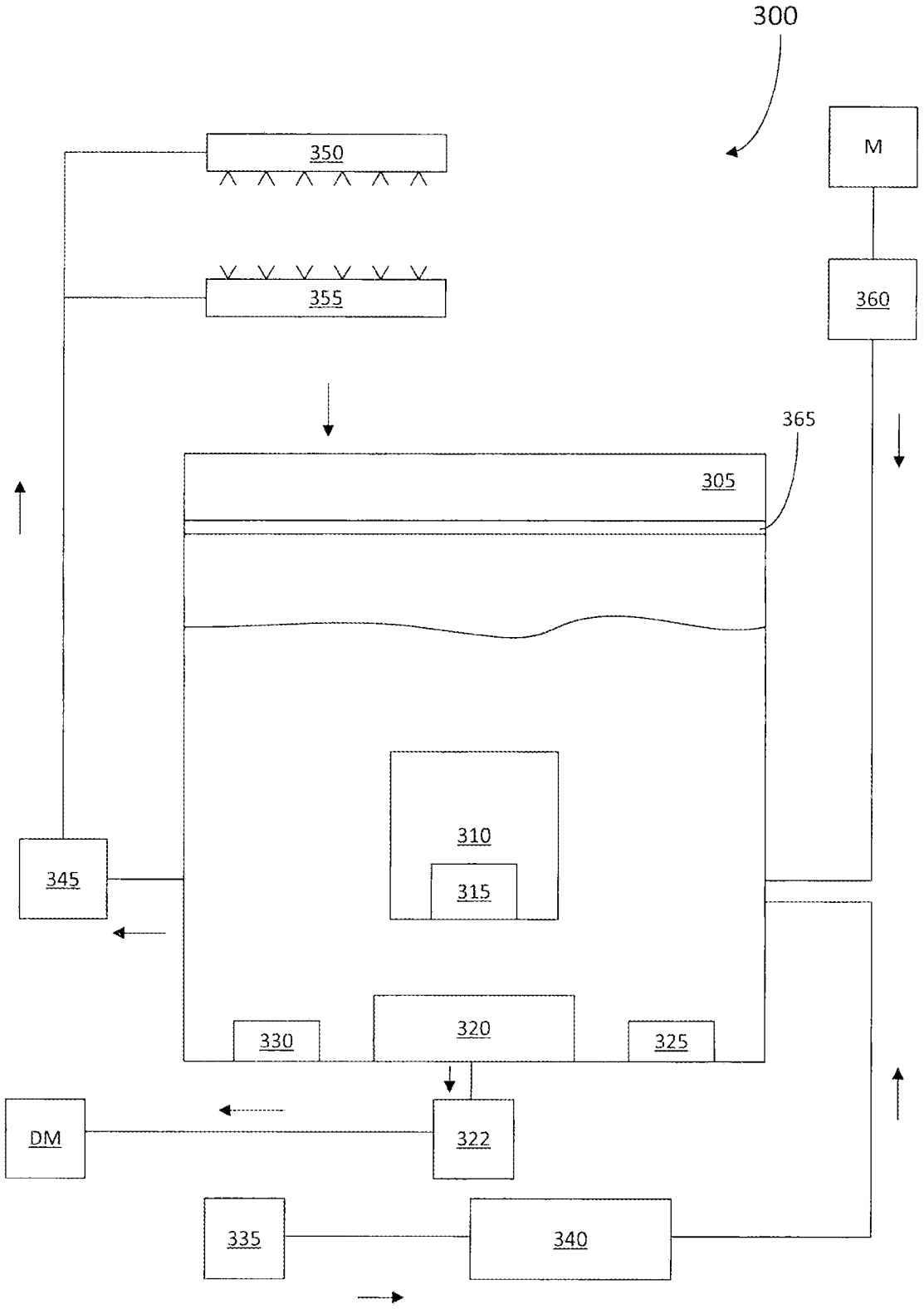
FIG. 3 is a schematic view of a wash system forming part of the on-demand glasswasher of FIG. 1.

The wash system 300 is shown in FIG. 3. The wash system 300 includes a wash tank 305, a heater 310, a bi-metal safety 315, a drain 320, a fluid level sensor assembly 325, a thermistor 330, a detergent dispenser 335, an injector 340, a pump 345, upper wash arms 350, lower wash arms 355, a valve 360 and a screen 365.

The wash tank 305 receives water from water mains M via the valve 360. Put another way, the valve 360 is connected to the water mains and is used to selectively fill the wash tank 305 with water from the water mains M. The valve 360 may be connected to and controlled by the control system 200.

The heater 310 is located within the wash tank 305 and is configured to heat water stored in the wash tank 305. The bi-metal safety 315 is connected to the heater 310 and is configured to monitor a temperature of the heater. In the event that the temperature of the heater 310 goes above a threshold temperature, the bi-metal safety 315 is configured to shut-off the heater. The heater 310 and/or the bi-metal safety 315 may be connected to and controlled by the control system 200.

The drain 320 is located in the bottom of the wash tank 305 and is configured to drain water and/or soap water from the wash tank 305. In one or more embodiments, the drain 320 may be connected to a drain pump 322 that may be used to pump the drain water and/or soap water to drain mains DM. The drain 320 and/or drain pump 322 may be connected to and controlled by the control system 200.

The fluid level sensor assembly 325 is located within the wash tank 305 and is configured to monitor a level of fluid in the wash tank 305. Specifically, the fluid level sensor assembly 325 emits ultrasonic signals into the wash tank 305. The ultrasonic signals are reflected back to the fluid level sensor assembly 325. The fluid level sensor assembly 325 receives the reflected ultrasonic signals and communicates the reflected ultrasonic signals to the control system 200 where they are processed to determine the level of fluid in the wash tank 305.

The thermistor 330 is located within the wash tank 305 and is configured to monitor a temperature of the water in the wash tank 305. The thermistor 330 may be connected to and controlled by the control system 200.

The detergent dispenser 335 provides detergent to the wash tank 305 via the injector 340. The injector 340 may be connected to and controlled by the control system 200.

Within the wash tank 305, the water contained therein and the detergent are combined to create soap water that may be used to clean one or more objects as they travel along at least a portion of the rotary conveyor. Specifically, the pump 345 is connected to the wash tank 305 and is configured to pump soap water contained in the wash tank 305 to the upper wash arms 350 and the lower wash arms 355.

The upper wash arms 350 and lower wash arms 355 are positioned to dispense the soap water received from the wash tank 305 via the pump 345. Specifically, the upper wash arms 350 and the lower wash arms 355 are positioned above and below the rotary conveyor (not shown in FIG. 3), respectively. In this embodiment, the upper wash arms 350 are connected to a housing of the upper spray arm assembly 500 and the lower wash arms 355 are connected to a housing of the lower spray arm assembly 505, the details of which are described in more detail below. Each one of the wash arms includes at least one nozzle configured to direct the egress of soap water towards the rotary conveyor (not shown). The at least one nozzle may include a plurality of nozzles. In this manner, soap water from the wash tank 305 is used to clean one or more objects as they travel along the rotary conveyor (not shown).

The screen 365 is positioned between the upper wash arms 350 and the lower wash arms 355 and the wash tank 305. The screen 365 is used to capture or filter debris received from the one or more objects as they are cleaned.

During operation of the wash system 300, the wash tank 305 is filled with a predefined amount of water via the valve 360 and is filled with a predefined amount of detergent from the detergent dispenser 335 via the injector 340. The water and the detergent are combined within the wash tank 305 to create soap water. The soap water is heated to a predefined temperature using the heater 310.

As objects travel along a portion of the rotary conveyor, soap water is directed out of the nozzles of the upper wash arms 350 and the lower wash arms 355 and towards the objects. The soap water cleans the objects and excess soap water and any debris from the objects travels through the screen 365 and back into the wash tank 305. In the event that the amount of soap water in the wash tank 305 drops below a certain level, the control system 200 may perform operations to refill or top-up the wash tank 305 with water and detergent. In this manner, the wash system 300 may operate continuously to clean objects as they are placed on the rotary conveyor.

The rinse system 400 is positioned downstream of the wash system 300. Put another way, as objects travel along the rotary conveyor, they pass through the wash system 300 and then pass through the rinse system 400. In this manner, the objects are rinsed by the rinse system 400 after they are washed by the wash system 300.

Figure 4:
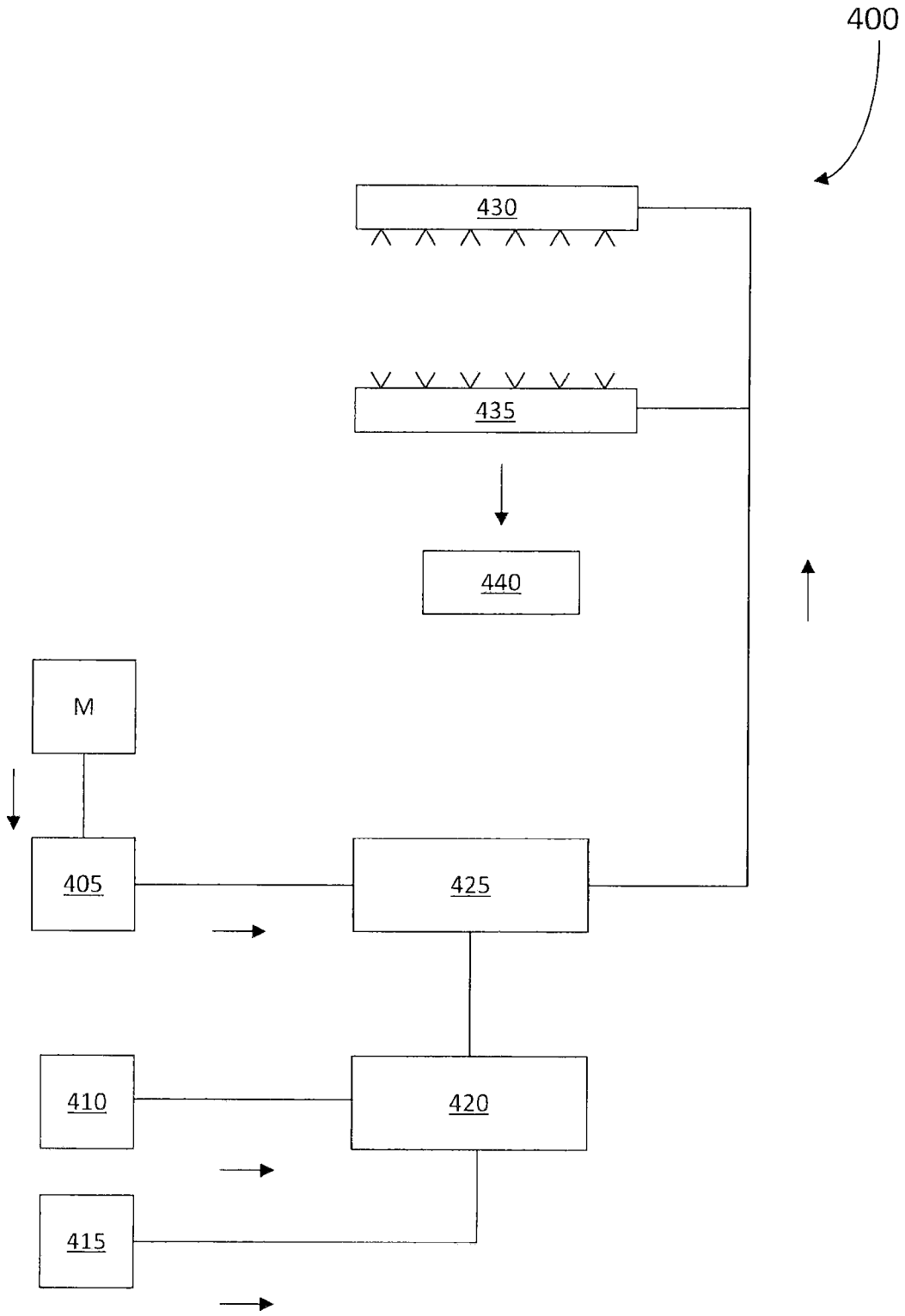
FIG. 4 is a schematic view of a rinse system forming part of the on-demand glasswasher of FIG. 1.

The rinse system 400 is shown in FIG. 4. The rinse system 400 includes a valve 405, a sanitizer dispenser 410, a rinse-aid dispenser 415, an injector 420, an injection fitting 425, upper rinse arms 430, lower rinse arms 435 and a drain 440.

The rinse system 400 receives water from the water mains M via the valve 405. It will be appreciated that the water received from the water mains M may be cold water, that is, the water is not heated. The water travels to the injection fitting 425. The valve 405 may be connected to and controlled by the control system 200.

The sanitizer dispenser 410 provides sanitizer to the injection fitting 425 via the injector 420 and similarly the rinse-aid dispenser 415 provides rinse-aid to the injection fitting 425 via the injector 420. The injector 420 may be connected to and controlled by the control system 200. The injector 420 may be the same injector as the injector 340 of the wash system 300.

The injection fitting 425 receives the water from the water mains via the valve 405, the sanitizer from the sanitizer dispenser 410 via the injector 420, and rinse-aid from the rinse-aid dispenser 415 via the injector 420 and provides the mixture to the upper rinse arms 430 and the lower rinse arms 435.

The upper rinse arms 430 and the lower rinse arms 435 are positioned to dispense the mixture received from the injection fitting 425. Specifically, the upper rinse arms 430 and the lower rinse arms 435 are positioned above and below the rotary conveyor (not shown), respectively. In this embodiment, the upper rinse arms 430 are connected to the housing of the upper spray arm assembly 500 and the lower rinse arms 435 are connected to the housing of the lower spray arm assembly 505, the details of which are described in more detail below. Each one of the rinse arms includes at least one nozzle that is configured to direct the egress of the mixture towards the rotary conveyor (not shown). The at least one nozzle may include a plurality of nozzles. In this manner, the mixture of water, sanitizer and rinse-aid is used to rinse one or more objects as they travel along the rotary conveyor (not shown).

The drain 440 is located below the upper rinse arms 430 and the lower rinse arms 435. The drain 440 is configured to drain the mixture from the rinse system 400. The drain 440 may be connected to drain mains and as such the mixture received by the drain 440 may be drained out through the drain mains. Similar to the drain 320, the drain 440 may be connected to a drain pump which may be used to pump the mixture to the drain mains. The drain 440 and/or the drain pump may be connected to and controlled by the control system 200. A screen may be provided to capture or filter debris received from the one or more objects as they are rinsed and the screen may be positioned between the upper rinse arms 430 and the lower rinse arms 435 and the drain 440.

During operation of the rinse system 400, the injection fitting 425 receives the water from the water mains via the valve 405, the sanitizer from the sanitizer dispenser 410 via the injector 420, and rinse-aid from the rinse-aid dispenser 415 via the injector 420 and provides the mixture to the upper rinse arms 430 and the lower rinse arms 435.

After being washed by the wash system 300, objects travel along a portion of the rotary conveyor towards the rinse system 400. As the objects travel through the rinse system 400, the mixture is directed out of the nozzles of the upper rinse arms 430 and the lower rinse arms 435 towards the objects. The mixture rinses the objects and excess mixture travels down through the drain 440.

As mentioned, the upper wash arms 350 and the upper rinse arms 430 are connected to a housing of the upper spray arm assembly 500 and the lower wash arms 355 and the lower rinse arms 435 are connected to a housing of the lower spray arm assembly 505.

The housing of the upper spray arm assembly and the housing of the lower arm spray assembly define at least one locating port that includes an opening. A spring-loaded connector that has a body complementary in shape to the locating port is used to connect the upper wash arms and upper rinse arms (or lower wash arms and lower rinse arms) to the housing.

In one or more embodiments, the spring-loaded connector includes a body and a yoke pivotally connected to the body via a torsion spring. The housing may include a feature that exerts a force on the yoke during insertion of the spring-loaded connector into the locating port and causes the yoke to pivot with respect to the body during the insertion. Prior to insertion, the torsion spring is in an unloaded position, during insertion, the torsion spring moves to a loaded position, and once connected to the housing the torsion spring moves back to the unloaded position.

The spring-loaded connector connects to at least one spray arm. In one or more embodiments, the spring-loaded connector connects to two spray arms such that the two spray arms extend out from the spring-loaded connector in a V-shape formation. It will be appreciated that the two spray arms may include two wash arms or two rinse arms.

Figure 5:
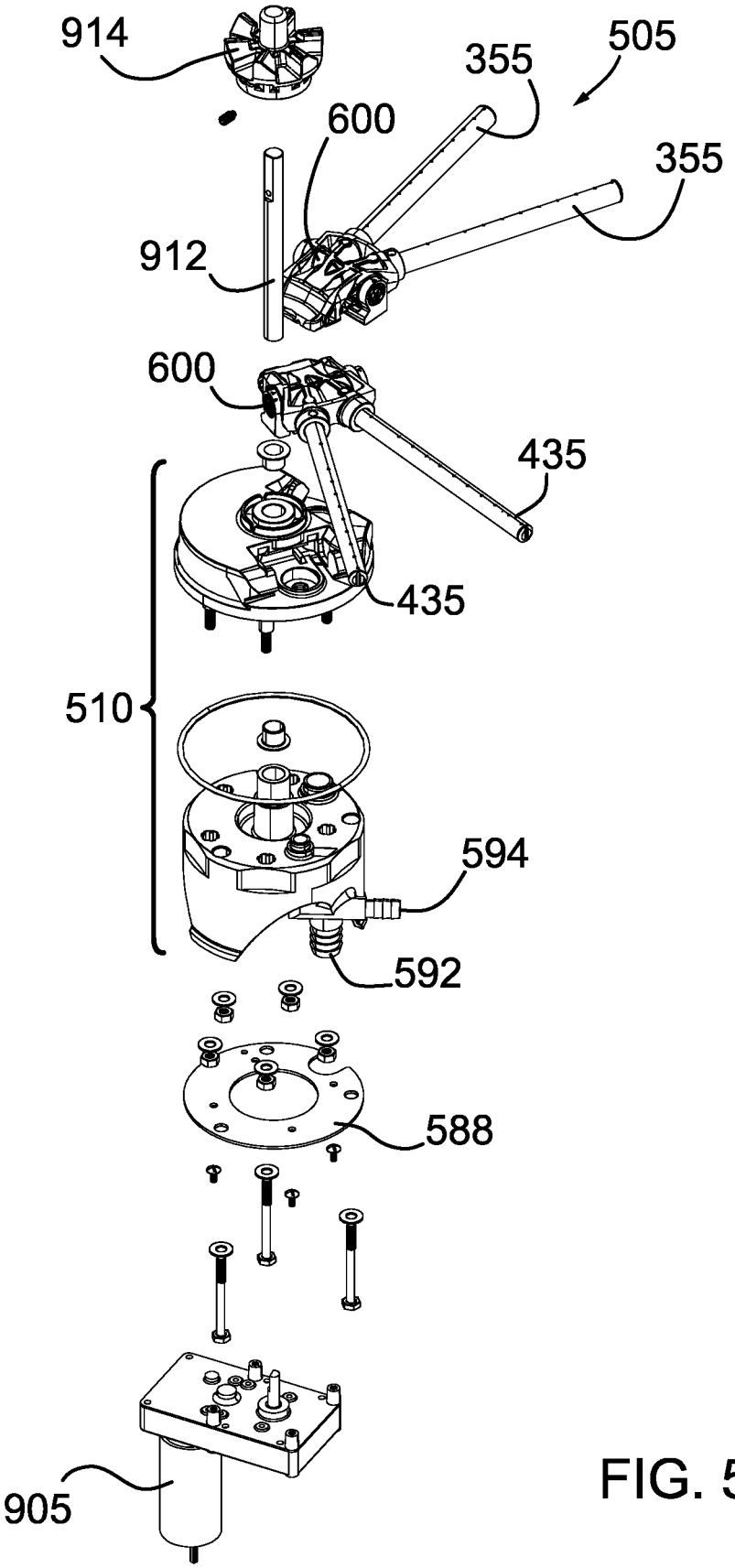
FIG. 5 is an exploded view of a lower spray arm assembly and a motor and conveyor system forming part of the on-demand glasswasher of FIG. 1.

An exploded view of the lower spray arm assembly 505 is shown in FIG. 5. As can be seen, the lower spray arm assembly 505 includes a housing 510, spring-loaded connectors 600 that hold the lower wash arms 355 and the lower rinse arms 435, a metal plate 588 that may be used to connect a motor 905 of the motor and conveyor system 900, and various connectors used to connect the various components of the lower spray arm assembly 505 together. Also shown in FIG. 5 is a drive shaft 912 and a conveyor drive gear 914 of the motor and conveyor system 900, which will be described in more detail below.

Figure 6:
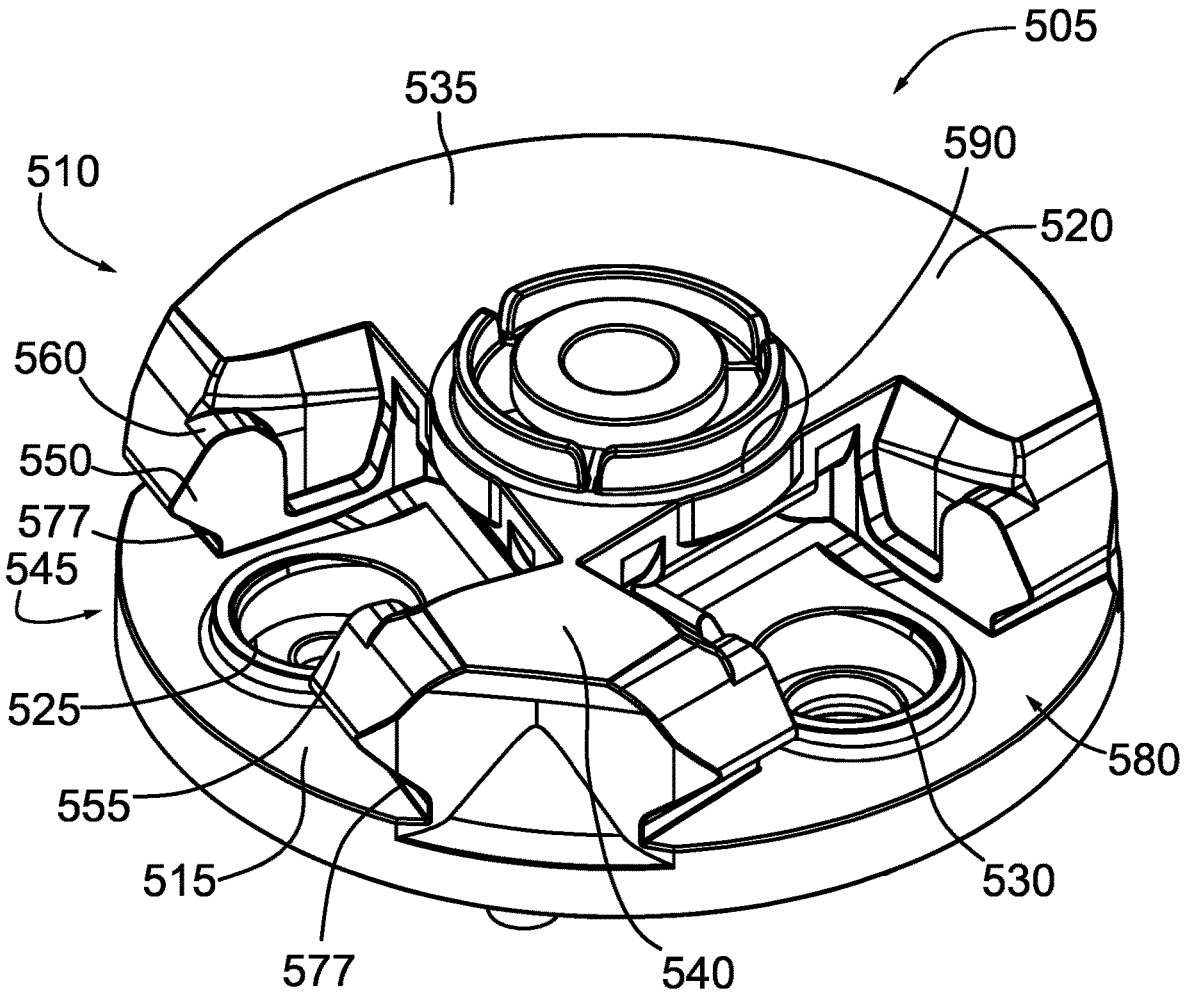
FIG. 6 is a top isometric view of a housing of a lower spray arm assembly forming part of the on-demand glasswasher of FIG. 1.

A top isometric view of the housing 510 of the lower spray arm assembly 505 is shown in FIG. 6. The housing 510 includes a lower housing portion 515 and an upper housing portion 520.

The lower housing portion 515 is generally disc shaped and includes two spaced apart openings 525, 530 defined therein. In this embodiment, the two spaced apart openings 525, 530 are defined in the lower housing portion 515 at approximately ninety (90) degrees from one another. A front portion of each opening 525, 530 may be tapered to accommodate for insertion and removal of a spring-loaded connector.

The upper housing portion 520 is positioned or connected to a top surface of the lower housing portion 515. The upper housing portion 520 includes a first part 535 that extends around approximately two hundred and seventy (270) degrees of the lower housing portion 515 between the two spaced apart openings 525, 530. The upper housing portion 520 includes a second part 540 that is positioned within the ninety (90) degrees between the two spaced apart openings 525, 530.

A first locating port 545 is defined on the top surface of the lower housing portion 515 above the opening 525 and between the first part 535 and the second part 540 of the upper housing portion 520. The first locating port 545 includes a first side wall 550 defined by an end of the first part 535 of the upper housing portion 520 and a second side wall 555 defined by an end of the second part 540 of the upper housing portion 520. Shoulders 560 are defined in the first side wall 550 and the second side wall 555 that are complementary in shape to sides of a spring-loaded connector (described in more detail below). The shoulders 560 are dimensioned to engage with and support the spring-loaded connector as it is being inserted to and eventually connected to the housing 510. In this manner, the shoulders 560 may act as a cam surface during insertion of the spring-loaded connector. Recessed portions 577 are defined on the first part 535 and the second part 540 of the upper housing portion 520 adjacent to the lower housing portion 515 and on opposite sides of the first locating port 545. The second side wall 555 is generally similar to the first side wall 550.

A second locating port 580 is defined on the top surface of the lower housing portion 515 above the opening 530 and between the first part 535 and the second part 540 of the upper housing portion 520. In this embodiment, the second locating port 580 is generally similar to the first locating port 545.

A center opening 585 is defined in the housing 510 and extends through the lower housing portion 515 and the upper housing portion 520. The center opening 585 is dimensioned to circumscribe a drive shaft of the motor and conveyor system 900. The metal plate 588 may be used to support and connect to a motor of the motor and conveyor system 900. A ridge 590 is defined within the first locating port 545 and the second locating port 580 adjacent to the center opening 585.

As shown in FIG. 5, the housing 510 includes a first inlet 592 that may connect to a pump, such as for example a pump of the wash system 300. The first inlet 592 may be configured to direct the ingress of fluid received from the pump to the openings 525, 530 of the housing 510. The housing 510 may include a second inlet 594 that may connect to the injection fitting 425 of the rinse system 400. The second inlet 594 may be configured to direct the ingress of fluid received by way of the injection fitting 425 towards the nozzles of the lower wash arms and/or lower rinse arms.

In one or more embodiments, the housing 510 may include one or more features to ensure the wash arms and the rinse arms are not positioned in the incorrect port. The features may identify a locating port as one of a wash arm port and a spray arm port. For example, one of the ports may include a feature such as a protrusion that extends generally upwards in a position to mate with or engage with a feature on one of the spring-loaded connectors. As such, only a spring-loaded connector that has a feature positioned to mate with or engage with the protrusion may be positioned and connected in the port.

As mentioned, the lower wash arms 355 and the lower rinse arms 435 are connected to the housing 510 of the lower spray arm assembly 505 via a spring-loaded connector.

An example spring-loaded connector 600 is shown in FIGS. 7A, 7B, 8 and 9A to 9D. In this embodiment, the spring-loaded connector 600 includes a body 610, a yoke 615 and spring mechanisms 620.

The body 610 is generally complementary in shape to the first locating port 545 and/or the second locating port 580. Specifically, the body 610 includes side portions 625 that are dimensioned and shaped to engage with the first side wall and the second side wall of the first and second locating ports. A front end 630 of the spring-loaded connector 600 is complementary in shape to the ridge 590 of the first and second locating ports 545, 580. A protuberance 635 extends out of each side of the body 610. The protuberance 635 is defined by a generally circular outer wall 640 that extends from the side of the body 610. The circular outer wall 640 has an opening 645 and a slot 650 defined therein. An opening 655 is defined in the body 610 within the middle of the circular outer wall 640. A generally circular inner wall 660 extends about the opening 655. The body 610 includes an inlet 760 (shown best in FIG. 7B) that is dimensioned to extend at least partially into one of the openings 525, 530 of the housing 110. In one or more embodiments, an O-ring 762 may circumscribe the inlet 760 and may be used to seal a connection between the inlet 760 and the opening 525, 530. The inlet 760 is in fluid communication with outlets 750, 755 that are dimensioned to receive and retain one of the lower wash arms 355 or one of the lower rinse arms 435.

The yoke 615 is dimensioned to receive and retain a portion of the body 610. Specifically, the yoke 615 comprises a pair of grooves 675 defined therein. A pair of opposing side walls 680 extend upwards from an exterior of the grooves 675. Atop of each of the side walls 680 is generally complementary in shape to a bottom surface of the protuberance 635 on the body 610. A pair of openings 685 are defined in the yoke 615 such that they are positioned above and exterior to a respective one of the side walls 680. Each opening 685 is generally equal in circumference to the generally circular outer wall 640 of the body 610. A ridge 690 is defined within each opening 685. The yoke 615 comprises a pair of rounded surfaces 695 that are complementary in shape to the rounded portions 577 defined on the first part 535 and the second part 540 of the upper housing portion 520.

Each spring mechanism 620 include a torsion spring 700, a bearing 710 and a screw 720. The torsion spring 700 includes a first leg 722, a second leg 725, and active coils 730 positioned therebetween. The torsion spring 700 may have a free position (or unloaded position) of 180 degrees.

The bearing 710 has an interior portion 735 that is dimensioned to circumscribe the generally circular inner wall 660 on the body 610. The bearing 710 has an opening 740 defined in a middle thereof that is aligned with the opening 655 defined in the body 610 when the bearing 710 circumscribes the generally circular inner wall 660. An exterior portion 745 of the bearing 710 has a circumference that is greater than a circumference of the interior portion and is dimensioned to fit inside the ridge 690 of the yoke 615. The exterior portion defines an opening that is dimensioned to receive and retain the screw 720 such that a head of the screw 720 is generally flush with the exterior surface of the bearing 710 when the screw 720 has been inserted into the opening 655 on the body 610.

Figure 7A:
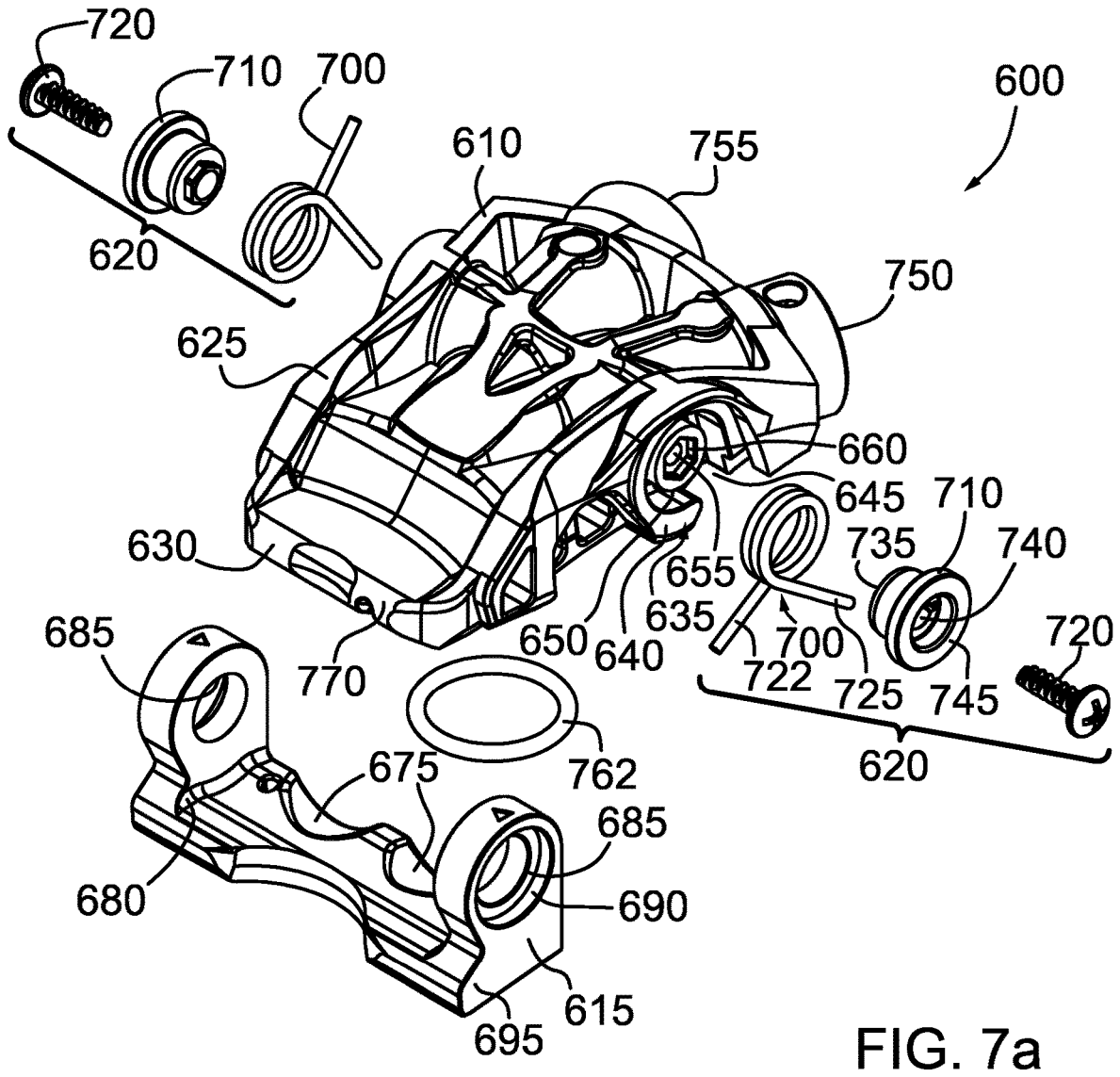
FIG. 7A is an exploded view of a spring-loaded connector forming part of the lower spray arm assembly of FIG. 5.
Figure 7B:
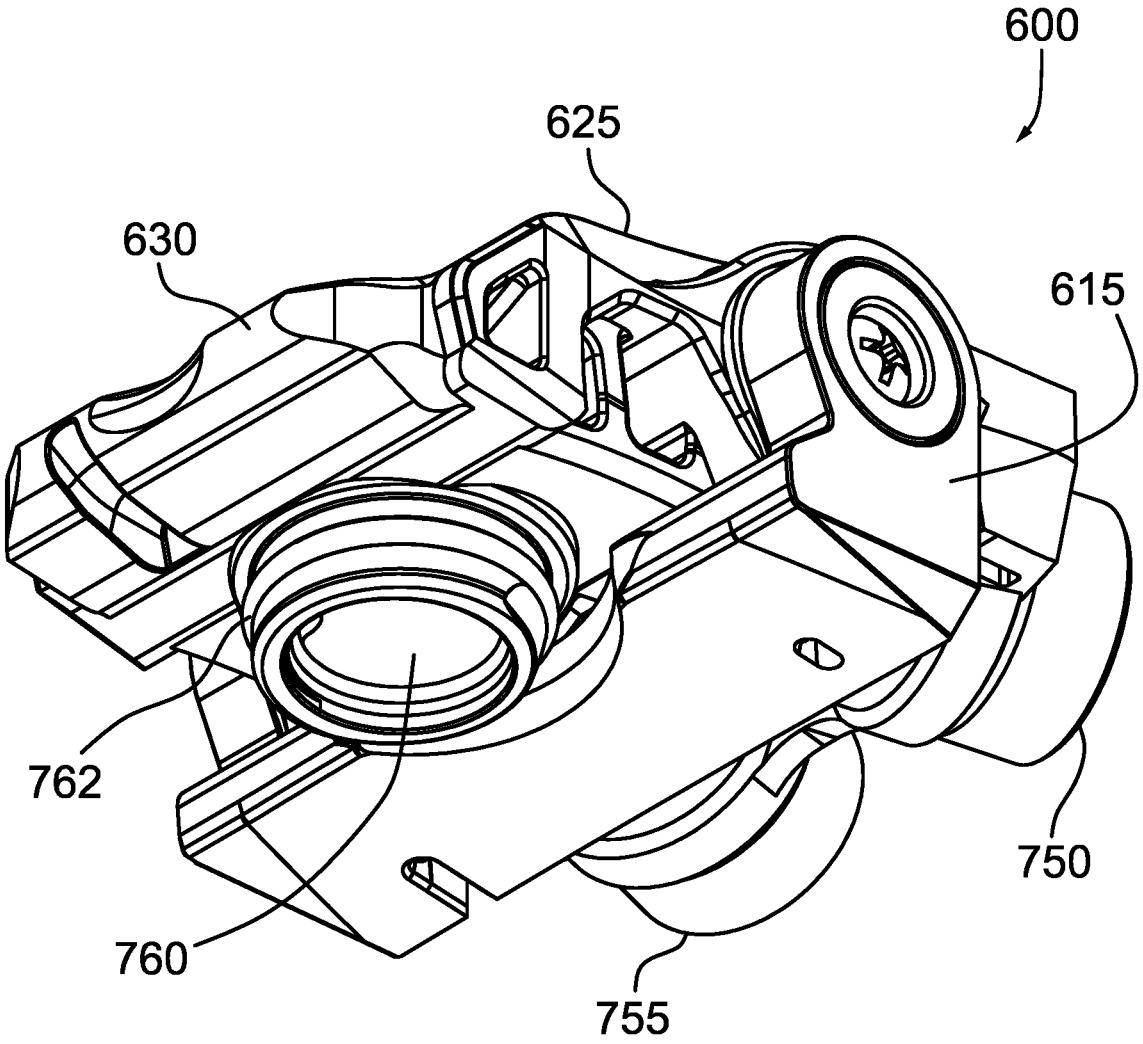
FIG. 7B is a bottom isometric view of the spring-loaded connector of FIG. 7A.
Figure 8:
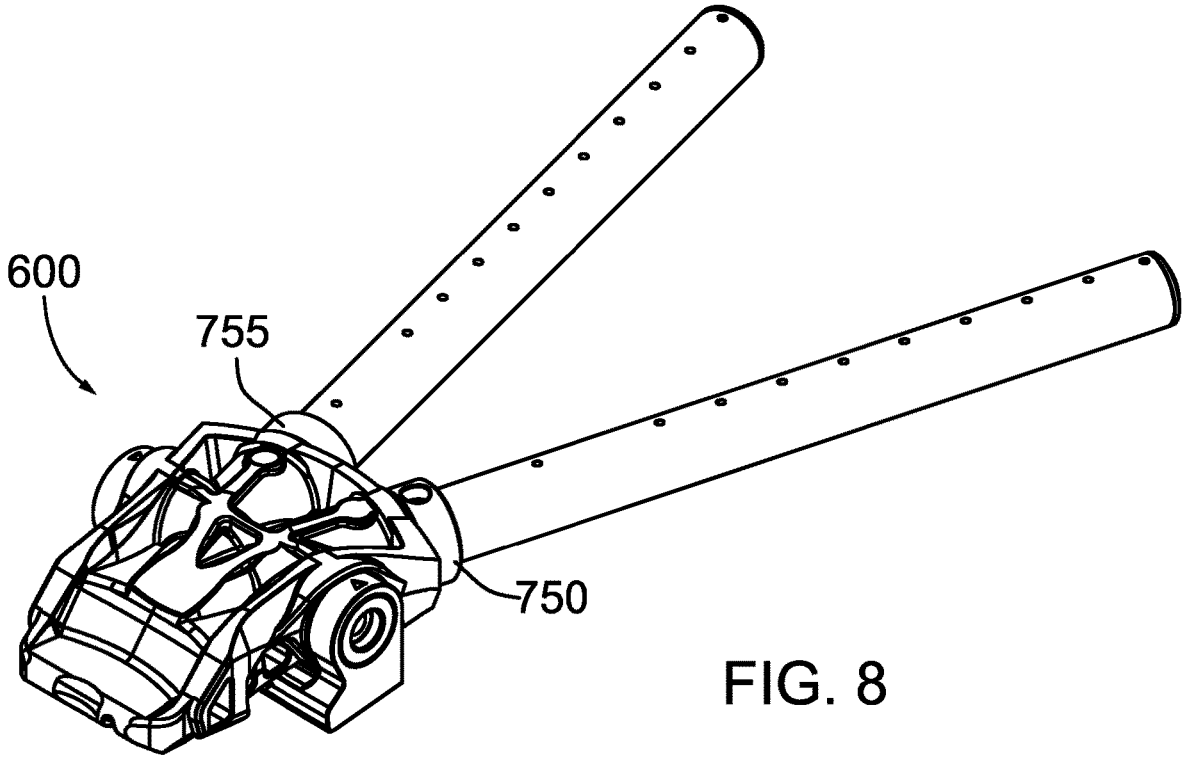
FIG. 8 is an isometric view of the spring-loaded connector of FIG. 7A.

As mentioned, in one or more embodiments, the housing 510 may include one or more features to ensure the wash arms and the rinse arms are not positioned in the incorrect port. The features may identify a locating port as one of a wash arm port and a spray arm port. For example, one of the ports may include a feature such as a protrusion that extends generally upwards in a position to mate with or engage with a feature on one of the spring-loaded connectors. As such, only a spring-loaded connector that has a feature positioned to mate with or engage with the protrusion may be positioned and connected in the port. The feature may identify the spring-loaded connector as one of a wash arm spring-loaded connector or a spray arm spring-loaded connector. Such a feature is shown in FIG. 7A. Specifically, the spring-loaded connector 600 includes a feature 770. The feature 770, in this embodiment, is a recess or void defined in the front end 630 of the spring-loaded connector 600. The feature 770 is positioned to engage with a protrusion extending within one of the ports to ensure that only the spring-loaded connector 600 having the correct spray arms (wash arms or rinse arms) is positioned in the correct port. It will be appreciated that the other type of spring-loaded connector may not have the feature 770 and as such will not be able to be positioned or connected into the port properly and this may server as an indication that this is the incorrect spring-loaded connector. In embodiments where the housing 510 and the spring-loaded connectors include features to ensure they are positioned in the correct ports, the spring-loaded connectors and the housing 510 may be described as being keyed.

Each spring-loaded connector 600 is assembled in the following manner. The torsion spring 700 is positioned within the generally circular outer wall 640 such that the first leg 722 extends through the opening 645 and the second leg 725 is located within the slot 650. The yoke 615 is positioned such that the openings 685 are aligned with the generally circular outer wall 640. The bearing 710 is positioned such that the interior portion 735 extends through the opening 685 and circumscribes the generally circular inner wall 660 on the body 610 and the exterior portion 745 is received by and contacts the ridge 690. The screw is inserted into the opening 740 on the bearing 710 and is rotated to engage with threadings defined within the opening 740 and the opening 655 on the body 610.

Once assembled, the torsion spring 700 retains the yoke 615 in position relative to the body 610. A force applied to the rounded surfaces 695 of the yoke 615 causes the second leg 725 of the torsion spring 700 to move within the slot 650 while the first leg 722 is secured in the opening 645. As such, the yoke 615 is able to rotate with respect to the body 610 in response to a force being applied to the rounded surfaces 695 thereof.

Figure 9A:
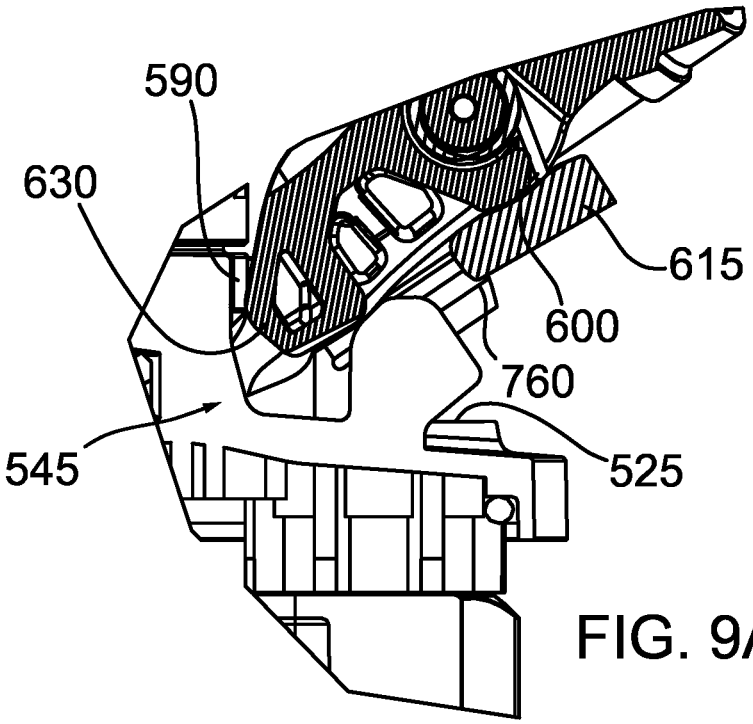
FIGS. 9A to 9D are side views showing the spring-loaded connector of FIG. 7A connecting to the lower spray arm assembly of FIG. 5.
Figure 9B:
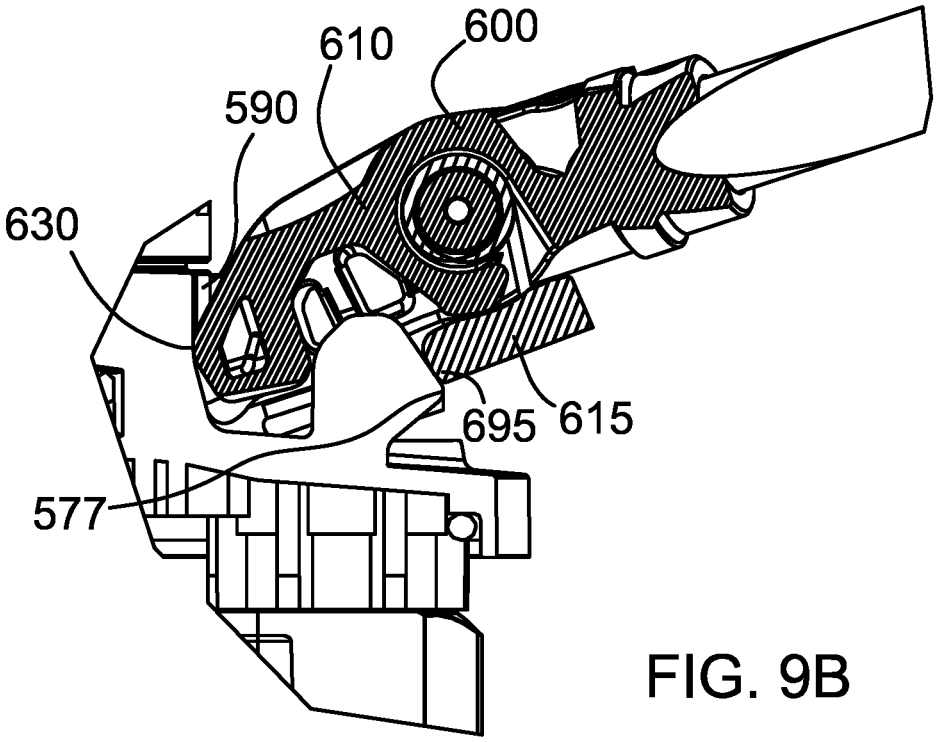
Figure 9C:
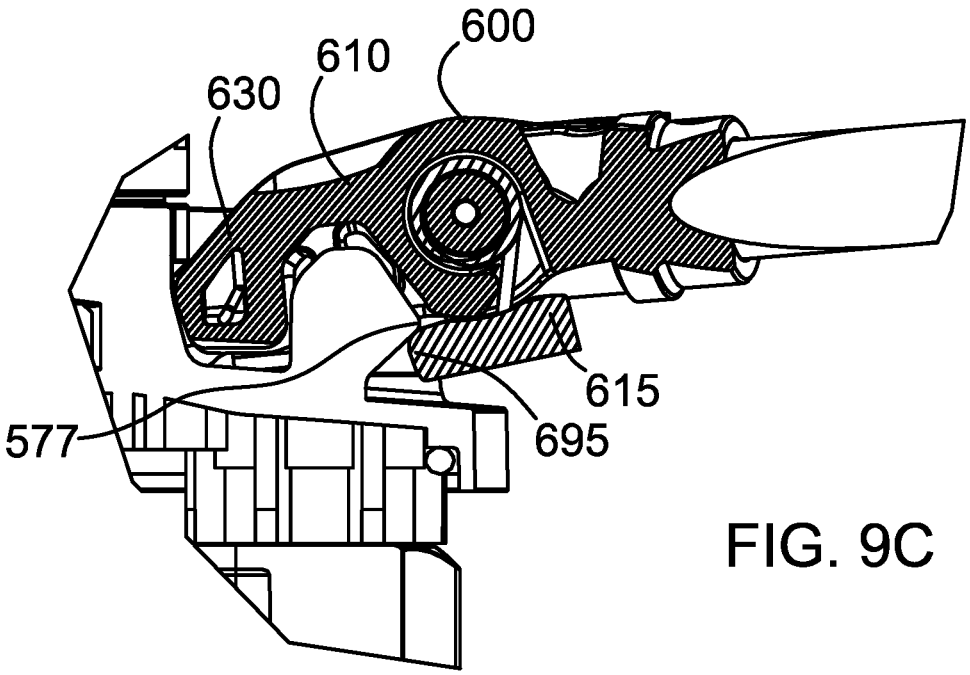

FIGS. 9A to 9D show example movement of the spring-loaded connector 600 as it is being connected to the housing 510. As shown in FIG. 9A, the spring-loaded connector 600 is inserted into one of the locating ports 545, 580 at an angle such that the front end 630 comes into contact the ridge 590. In FIG. 9A, the torsion spring 700 is in a free position.

Figure 9D:
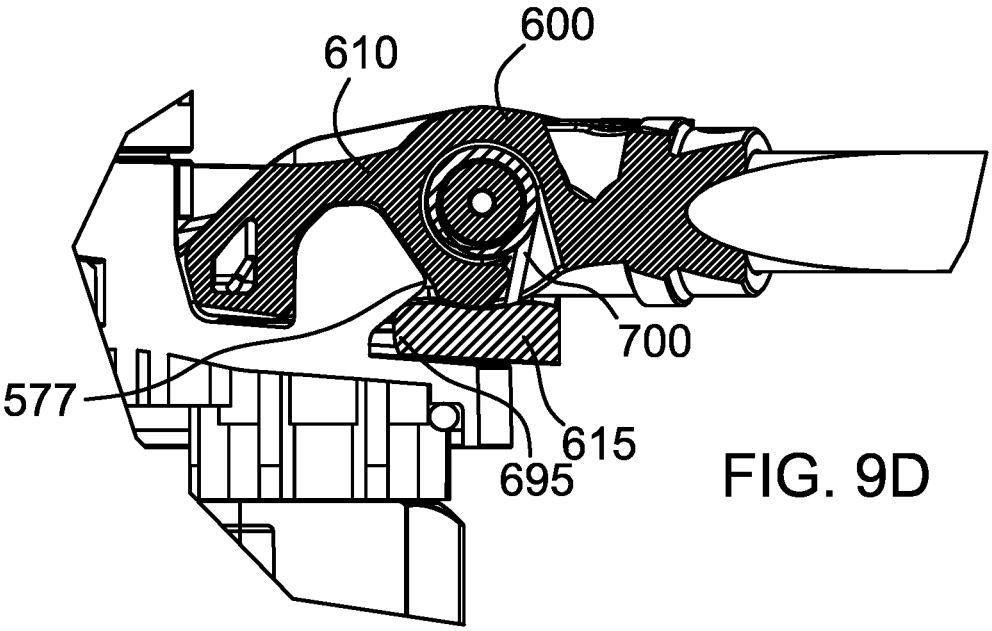

The spring-loaded connector 600 is lowered such that the rounded surfaces 695 of the yoke 615 contact the rounded portions 577 on the housing 510. The rounded portions 577 exert a force on the rounded surfaces 695 and in response the yoke 615 rotates or pivots relative to the body 610. The torsion spring 700 follows an installation path shown in FIGS. 9B and 9C where it is compressed from the free position due to the force exerted from the rounded portions 577. The spring-loaded connector 600 continues to be lowered until the force is released and the torsion spring 700 transitions to a locked position as shown in FIG. 9D. In this manner, the spring-loaded connector 600 connects to the housing 510.

When connected, an inlet 760 of the spring-loaded connector 600 extends into one of the openings 525, 530 on the lower housing portion 515. As mentioned, the inlet 760 is in fluid communications with outlets 750, 755 that are dimensioned to receive and retain one of the lower wash arms 355 or one of the lower rinse arms 435. As such, fluid from a fluid source, such as for example that received via an injection fitting or a pump as described herein, is directed from the inlet to the outlets 750, 755 and to the lower wash arms 355 or the lower rinse arms 435.

Through use of the spring-loaded connectors 600, the lower wash arms 355 and the lower rinse arms 435 are readily removable from the housing 510 and this allows them to be easily cleaned or replaced.

Figure 10:
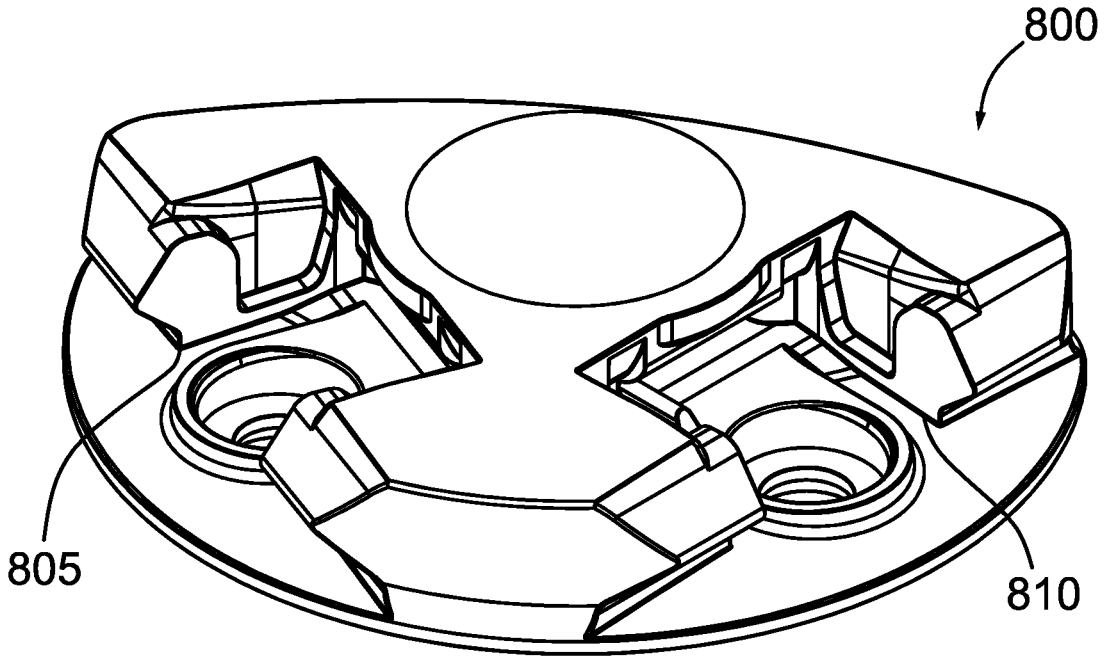
FIG. 10 is an isometric view of a housing of an upper spray arm assembly forming part of the on-demand glasswasher of FIG. 1.

Turning to FIG. 10, the housing 800 of the upper spray arm assembly is shown. As can be seen, the housing 800 includes locating ports 805, 810 that are generally similar to that of the housing 510 of the lower spray arm assembly 505. The upper wash arms 350 and the upper rinse arms 430 may be connected to the housing 800 of the upper spray arm assembly using spring-loaded connectors similar to that described herein. Through use of the spring-loaded connectors, the upper wash arms 350 and the upper rinse arms 430 are readily removable from the housing of upper spray arm assembly and this allows them to be easily cleaned or replaced.

Figure 11:
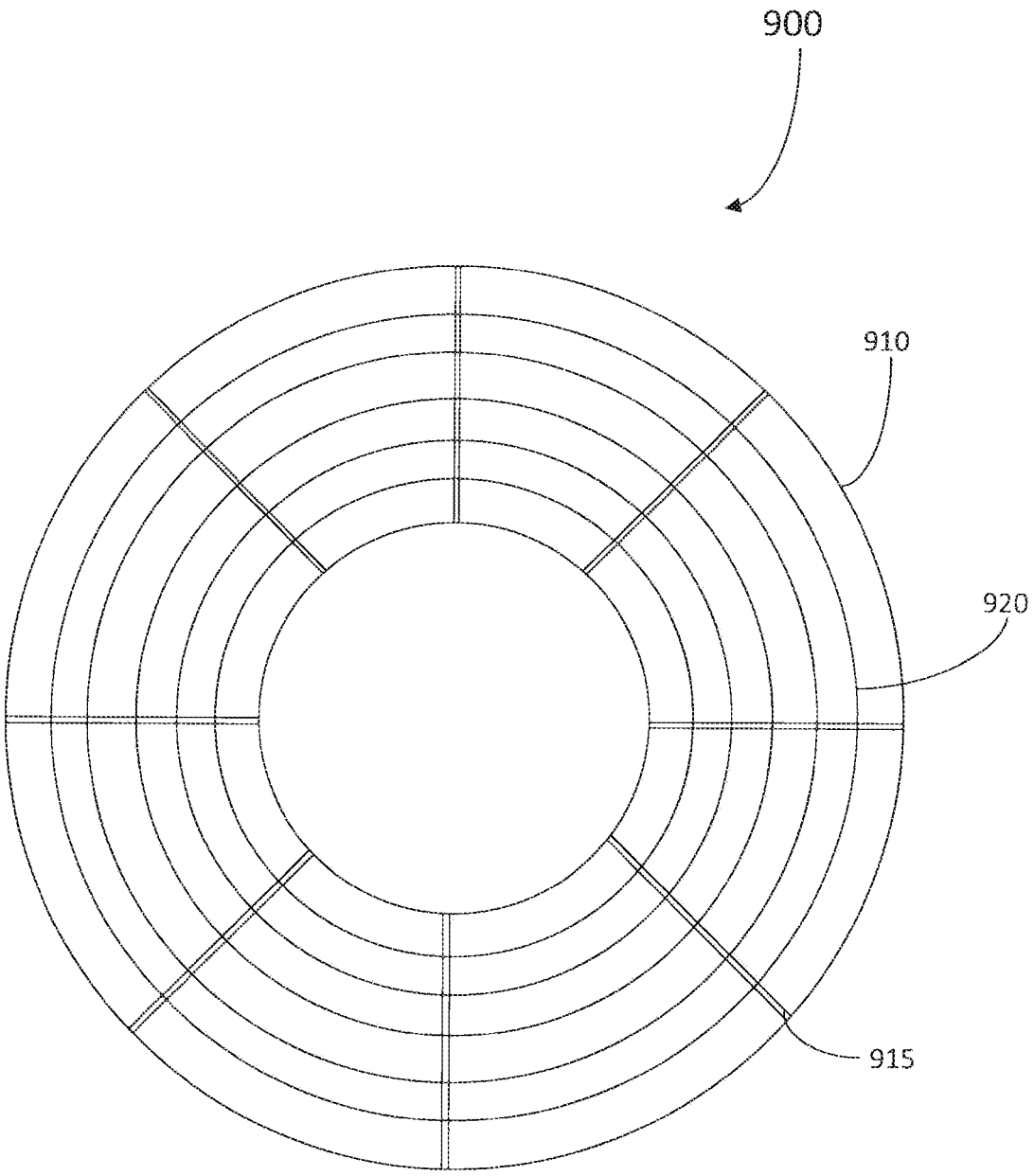
FIG. 11 is a top plan view of a motor and conveyor system forming part of the on-demand glasswasher of FIG. 1.

As shown in both FIGS. 5 and 11, the motor and conveyor system 900 includes a motor 905 and a rotary conveyor 910. In this embodiment, the motor 905 is a drive motor that is connected to the rotary conveyor 910 via a drive shaft 912 and conveyor drive gear 914 such that rotation of the motor 905 causes rotation of the rotary conveyor 910. The motor 905 is connected to and controlled by the control system 200.

In this embodiment, the rotary conveyor 910 comprises a plurality of concentric ribs 915 and a plurality of radially extending vanes 920. The radially extending vanes 920 are connected to the concentric ribs 915. The conveyor drive gear 914 includes guides or teeth that are angled to receive the rotary conveyor 910 and ensure it is held in the correct position. Put another way, the conveyor drive gear 914 includes guides or teeth that define slots that are complimentary in shape with the vanes 920 and/or the ribs 915 and are used to connect the rotary conveyor 910 to the drive shaft 912 and to ensure that the rotary conveyor 910 is held in the correct position.

Although not shown in FIG. 11, the motor and conveyor system 900 may additionally include one or more components that may be used to control the operation thereof. For example, the motor and conveyor system 900 may include a sensor such as a proximity sensor that may be used to detect the presence of one or more objects on the rotary conveyor 910 which in turn may be used to control the operation of the on-demand glasswasher 100. For example, the sensor may communicate with the control system 200 to selectively start the motor 905 when no object is detected in proximity of the sensor and may selectively stop the motor 905 when an object is detected in proximity of the sensor.

Figure 12:
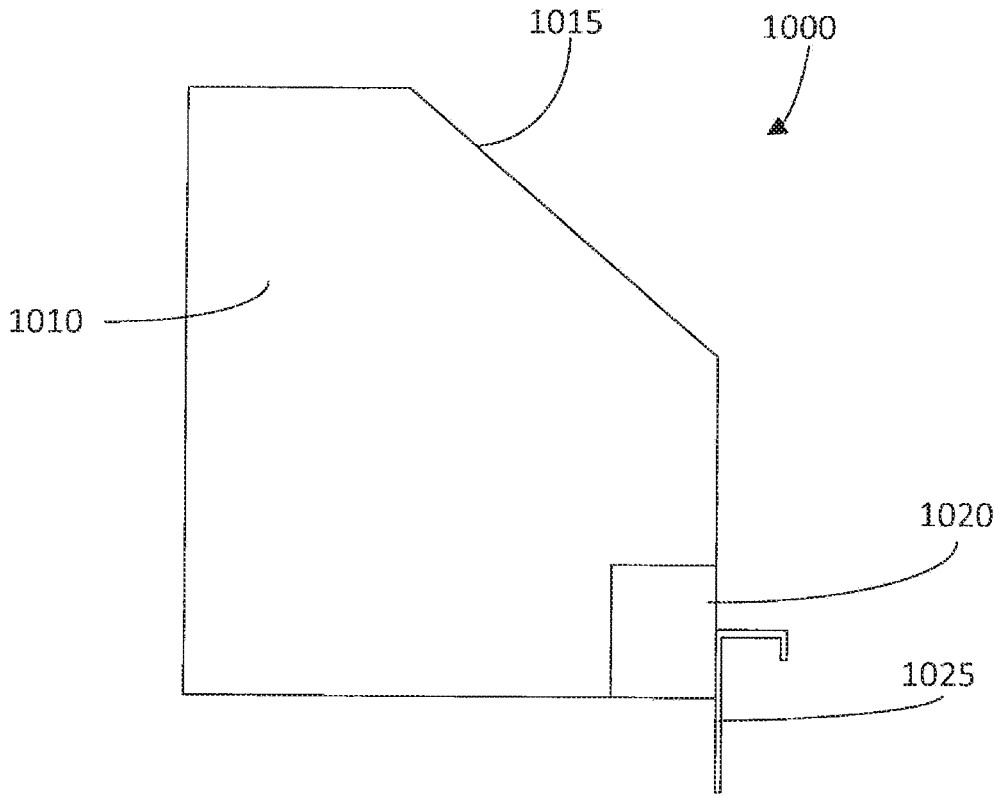
FIG. 12 is a side view of a sanitary divider forming part of the on-demand glasswasher of FIG. 1.

The sanitary divider 1000 is shown in FIG. 12. In this embodiment, the sanitary divider 1000 includes a panel 1010 that is made of a rigid material such as for example plastic and the rigid material may be transparent. The panel 1010 is generally rectangular and includes a tapered section 1015 at a top side thereof. The tapered section 1015 extends downward from the top surface to a side of the panel 1010. The sanitary divider 1000 includes a bracket 1020 that is dimensioned to receive and retain the panel 1010. Specifically, the bracket 1020 includes parallel spaced apart sections that define an opening to receive and retain a portion of the panel 1010. Fasteners such as screws may be used to secure the panel 1010 in the bracket 1020. The bracket 1020 includes a hook 1025 that is dimensioned to connect to a portion of the housing 110.

In one or more embodiments, the sanitary divider 1000 divides or separates a load zone and a clean zone of the on-demand glasswasher 100 and this may ensure any dirt or debris from dirty or unwashed glasses does not contact or soil clean glasses located in the clean zone.

Figure 13:
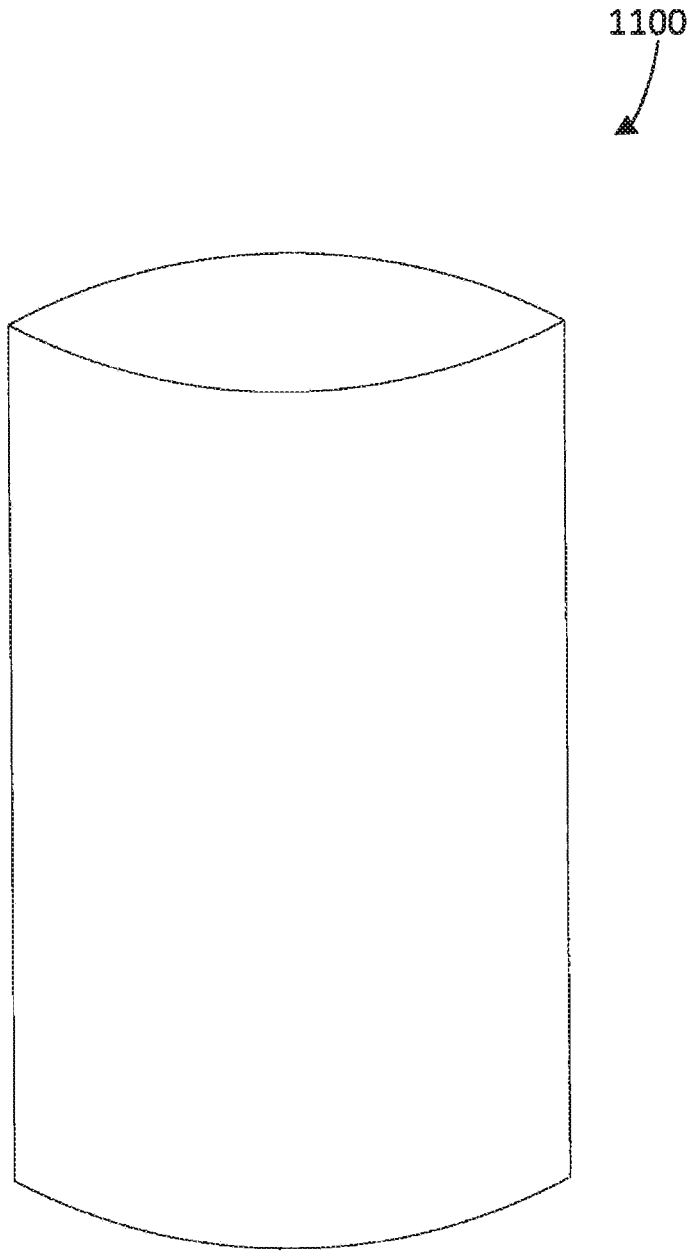
FIG. 13 is an isometric view of a cylinder forming part of the on-demand glasswasher of FIG. 1.

The cylinder 1100 is shown in FIG. 13. The cylinder 1100 may be made of a material such as for example stainless steel. The cylinder 1100 is dimensioned to be circumscribed by the rotary conveyor 910. Specifically, the cylinder 1100 is dimensioned to be positioned within the center of the rotary conveyor 910 such that at least a portion of the cylinder 1100 extends above the rotary conveyor 910 while still allowing the rotary conveyor 910 to rotate. The rounded surface of the cylinder 1100 prevents or otherwise minimizes the risk of glasses falling over or being scratched should they come into contact therewith.

Figure 14:
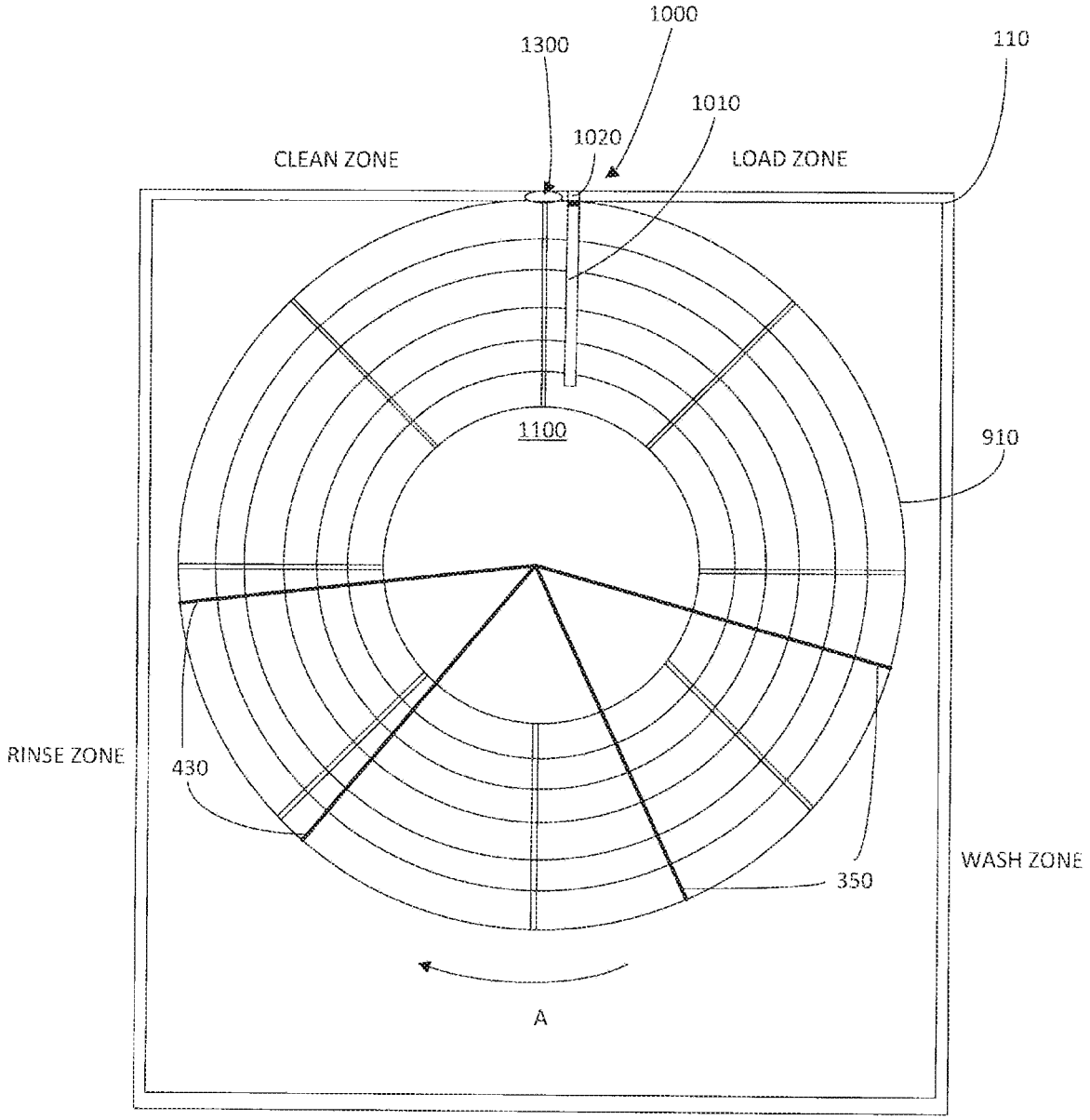
FIG. 14 is a top plan view of the on-demand glasswasher of FIG. 1.
Figure 15:
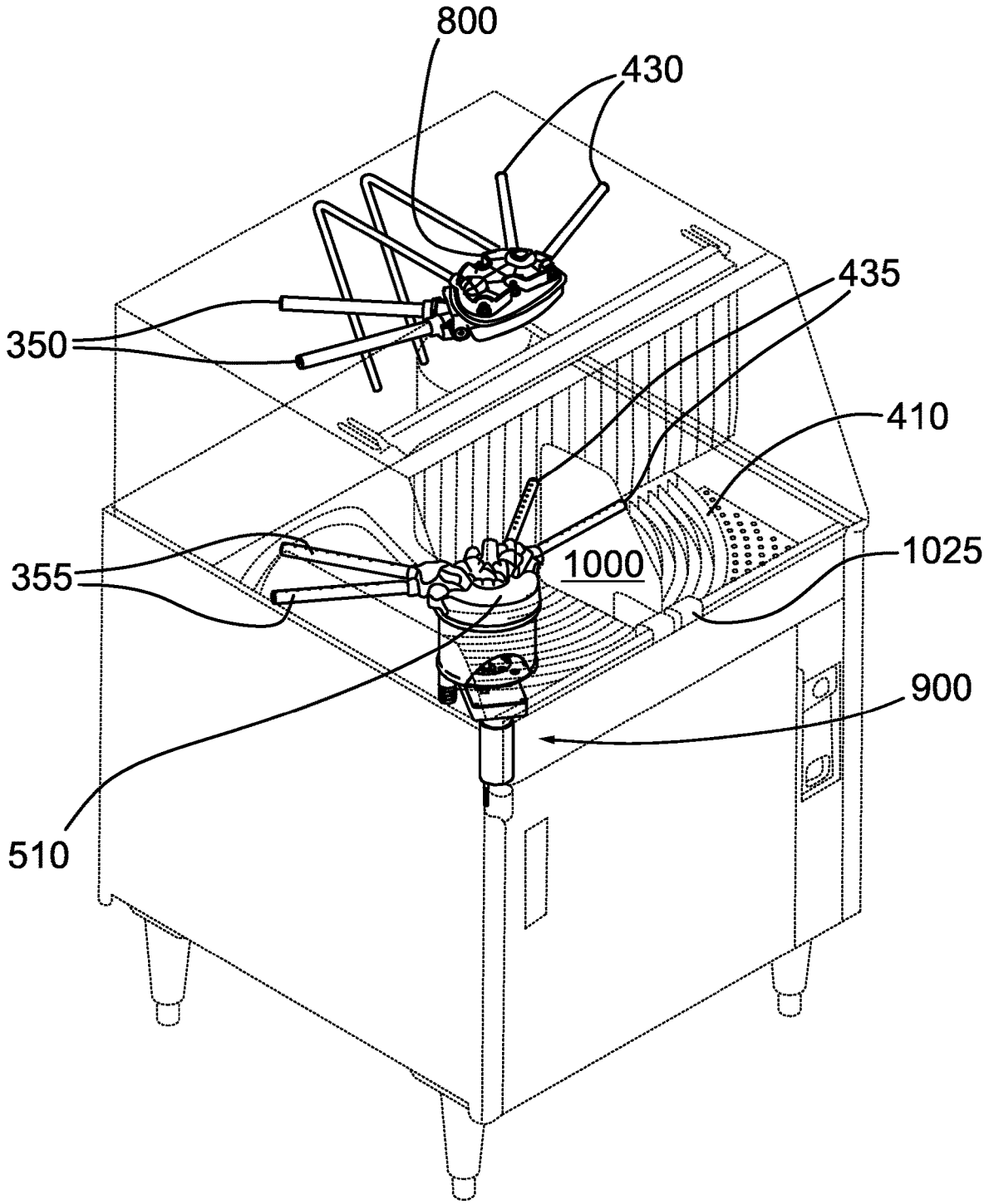
FIG. 15 is a top isometric view of the on-demand glasswasher of FIG. 1.

Assembly of various components of the on-demand glasswasher 100 will now be described with respect to FIG. 14 which is a top plan view of the on-demand glasswasher 100 and FIG. 15 which is a top isometric view of the on-demand glasswasher 100. It will be appreciated that the on-demand glasswasher 100 is shown without a top covering for illustrative purposes only in FIG. 14. It will be appreciated that various components of the on-demand glasswasher 100 are shown in FIG. 15 as being emphasized as visible and that this is for illustrative purposes only as at least a portion of these components may not be visible without removing components such as for example the top covering, etc.

The motor and conveyor system 900 are positioned within the housing 110. The upper wash arms 350 and the upper rinse arms 430 are connected to the housing 800. The lower wash arms 355 and the lower rinse arms 435 are connected to the housing 510 and are located directly beneath the upper wash arms 350 and the upper rinse arms 430, respectively.

As mentioned, the motor and conveyor system 900 may additionally include one or more components that may be used to control the operation thereof. In the example shown in FIG. 14, the motor and conveyor system 900 includes a sensor 1300 that is positioned within the housing 110 of the on-demand glasswasher 100.

The hook 1025 of the sanitary divider 1000 connects to a portion of the housing 110. In the example shown in FIG. 14, the sanitary divider 1000 is positioned adjacent to the sensor 1300 of the motor and conveyor system 900 and such that the panel 1010 extends into the housing 110.

The cylinder 1100 is positioned within the center of the rotary conveyor 910 such that at least a portion of the cylinder 1100 extends above the rotary conveyor 910 while still allowing the rotary conveyor 910 to rotate.

The on-demand glasswasher 100 includes four zones. A load zone is defined at a first end of the housing 110. The load zone may be defined on a particular side of the sanitary divider 1000. Specifically, the load zone may be defined such that any objects placed on the rotary conveyor 910 travel in a direction away from the sanitary divider 1000. During use, a user places objects to be cleaned onto the rotary conveyor 910 at a location that corresponds to the load zone.

A wash zone is defined intermediate the upper wash arms 350. The wash zone is downstream of the load zone. As objects travel along the rotary conveyor (in the direction indicated by arrow A in FIG. 14) into the wash zone, the objects are washed by the wash system 300 in manners described herein.

A rinse zone is defined intermediate the upper rinse arms 430. The rinse zone is downstream of the wash zone. As objects travel along the rotary conveyor (in the direction indicated by arrow A in FIG. 14) into the rinse zone, the objects are rinsed by the rinse system 400 in manners described herein.

A clean zone is defined at the front end of the housing 110. The clean zone is downstream of the rinse zone. The clean zone may be defined on a second side of the sanitary divider 1000. In this manner, the sanitary divider 1000 divides or separates the load zone and the clean zone and this may ensure any dirt or debris from dirty or unwashed glasses does not contact or soil clean glasses located in the clean zone. During use, once objects have been washed and rinsed, they remain in the clean zone until the user removes them from the rotary conveyor.

In one or more embodiments described herein, the spray arm assembly and/or the spring-loaded connector are described being keyed in that they included one or more features to ensure that the wash arms and the rinse arms are not positioned in the incorrect port. The features may identify a locating port as one of a wash arm port or a spray arm port and/or may identify a spring-loaded connector as one of a wash arm spring-loaded connector or a spray arm spring-loaded connector. For example, as described above, one of the ports may include a feature such as a protrusion that extends generally upwards and one of the spring-loaded connectors may have an opening that is positioned to receive the protrusion. As such, only a spring-loaded connector that has an opening may be positioned within the port that has the protrusion and this feature may be used to ensure that the correct spray arms are positioned in the correct port. It will be appreciated that in one or more embodiments, other types of features may be used. For example, each port may be colour-coded such that, for example, a blue port may be used for wash arms and a red port may be used for spray arms. The spring-loaded connectors may similarly be colour-coded to ensure that the wash arms and the spray arms are positioned in the correct port.

As noted, certain adaptations and modifications of the described embodiments can be made. Therefore, the above discussed embodiments are considered to be illustrative and not restrictive.

What is claimed is:

1. A spray arm assembly comprising:

a housing defining at least one locating port that includes at least one opening;

a spring-loaded connector having a body and a yoke pivotally connected to the body via a torsion spring, the body complementary in shape to the at least one locating port and removably connected to the housing within the at least one locating port, the spring-loaded connector having an inlet in fluid communication with the at least one opening when connected to the housing within the at least one locating port and at least one outlet; and at least one spray arm connected to the spring-loaded connector such that the spray arm is in fluid communication with the at least one outlet of the spring-loaded connector.

2. The spray arm assembly of claim 1, wherein the housing includes a feature that exerts a force on the yoke during insertion of the spring-loaded connector into the port and causes the yoke to pivot with respect to the body during the insertion.

3. The spray arm assembly of claim 1, wherein the torsion spring is in a locked position when the spring-loaded connector is connected to the housing.

4. The spray arm assembly of claim 1, wherein the torsion spring follows an installation path during insertion of the spring-loaded connector into the housing.

5. The spray arm assembly of claim 1, wherein the at least one locating port includes a feature to identify the at least one locating port as one of a wash arm port or a spray arm port.

6. The spray arm assembly of claim 5, wherein the spring-loaded connector includes a feature complementary to the feature of the at least one locating port to identify the spring-loaded connector as one of a wash arm spring-loaded connector or a spray arm spring-loaded connector.

7. The spray arm assembly of claim 1, wherein the housing includes a ridge that is positioned to receive and engage with an end of the spring-loaded connector during insertion of the spring-loaded connector.

8. The spray arm assembly of claim 1, wherein the spring-loaded connector includes side portions that are complementary in shape to shoulders defined in side walls of the at least one locating port.

9. The spray arm assembly of claim 1, wherein the at least one spray arm includes at least two spray arms connected to the spring-loaded connector.

10. The spray arm assembly of claim 9, wherein the at least two spray arms extend out from the spring-loaded connector in a V-shape formation.

11. The spray arm assembly of claim 1, wherein fluid is received from a fluid source and travels through the at least one opening in the housing, through the inlet of the spring-loaded connector, out through the at least one outlet of the spring-loaded connector to the at least one spray arm, and is directed out through at least one nozzle of the at least one spray arm.

12. The spray arm assembly of claim 1, wherein the at least one spray arm includes at least one of a wash arm or a rinse arm.

13. An on-demand glasswasher comprising:

a spray arm assembly fluidly connected to at least one of a rinse system or a wash system of the on-demand glasswasher, the spray arm assembly comprising:

a housing defining at least one locating port that includes at least one opening that receives fluid from the rinse system or the wash system;

a spring-loaded connector having a body and a yoke pivotally connected to the body via a torsion spring, the body complementary in shape to the at least one locating port and removably connected to the housing within the at least one locating port, the spring-loaded connector having an inlet in fluid communication with the at least one opening when connected to the housing within the at least one locating port and at least one outlet; and at least one spray arm connected to the spring-loaded connector such that the spray arm is in fluid communication with the at least one outlet of the spring-loaded connector.

14. The on-demand glasswasher of claim 13, wherein the spray arm assembly includes at least one of an upper spray arm assembly or a lower spray arm assembly.

15. The on-demand glasswasher of claim 13, wherein the spray arm assembly includes at least a first locating port that receives fluid from the rinse system and at least a second locating port that receives fluid from the wash system.

16. The on-demand glasswasher of claim 15, wherein the spray arm assembly includes at least a first spring-loaded connector removably connected to the housing within the first locating port and at least a second spring-loaded connector removably connected to the housing within the second locating port.

17. The on-demand glasswasher of claim 16, wherein the at least one spray arm includes at least one rinse arm connected to the first spring-loaded connector and at least one wash arm connected to the second spring-loaded connector.

18. The on-demand glasswasher of claim 13, wherein the spray arm assembly is positioned above or below a rotary conveyor of the on-demand glasswasher.

19. The on-demand glasswasher of claim 13, further comprising at least a first spray arm assembly positioned above a rotary conveyor of the on-demand glasswasher and at least a second spray arm assembly positioned below the rotary conveyor of the on-demand glasswasher.

* * * * *